US008238799B2

(12) United States Patent
Dawson et al.

(10) Patent No.: US 8,238,799 B2
(45) Date of Patent: Aug. 7, 2012

(54) CARTRIDGE ALIGNMENT MEMBER FOR ALIGNING WITH A DEVELOPER UNIT IN AN ELECTROPHOTOGRAPHIC IMAGE FORMING DEVICE

(75) Inventors: Jedediah Taylor Dawson, Lexington, KY (US); Shaun Singh Greywall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 388 days.

(21) Appl. No.: 12/486,824

(22) Filed: Jun. 18, 2009

(65) Prior Publication Data

US 2010/0322676 A1 Dec. 23, 2010

(51) Int. Cl.
*G03G 15/08* (2006.01)

(52) U.S. Cl. ..... 399/262; 399/119; 399/120; 399/258

(58) Field of Classification Search ..... 399/119, 399/120, 258, 262
See application file for complete search history.

(56) References Cited

U.S. PATENT DOCUMENTS

| | | | | |
|---|---|---|---|---|
| 5,689,773 | A * | 11/1997 | Ha | 399/106 |
| 6,115,571 | A * | 9/2000 | Kobayashi | 399/119 |
| 2005/0271425 | A1* | 12/2005 | Shimomura et al. | 399/258 |
| 2006/0083555 | A1* | 4/2006 | Uchiyama et al. | 399/258 |
| 2008/0101821 | A1* | 5/2008 | Gayne et al. | 399/258 |
| 2008/0317510 | A1* | 12/2008 | Choi et al. | 399/262 |
| 2009/0010679 | A1* | 1/2009 | Shimomura et al. | 399/119 |
| 2009/0016779 | A1* | 1/2009 | Hwang | 399/258 |
| 2009/0142103 | A1* | 6/2009 | Chaudhuri et al. | 399/262 |

* cited by examiner

*Primary Examiner* — David Gray
*Assistant Examiner* — G. M. Hyder
(74) *Attorney, Agent, or Firm* — John Victor Pezdek; Justin M Tromp

(57) ABSTRACT

An alignment member is externally disposed on a toner cartridge for alignment with a developer unit in an electrophotographic image forming device. In one embodiment of the invention, the alignment member includes a first portion to properly align the developer unit relative to the toner cartridge and a second portion to maintain the proper alignment of the developer unit. The alignment ensures proper installation of the toner cartridge into the image forming device and prevents undesirable spill of toner.

19 Claims, 11 Drawing Sheets

CARTRIDGE ALIGNMENT MEMBER FOR ALIGNING WITH A DEVELOPER UNIT IN AN ELECTROPHOTOGRAPHIC IMAGE FORMING DEVICE

BACKGROUND

1. Field of the Invention

The present invention relates to a cartridge alignment member for aligning a developer unit with respect to a toner cartridge in an image forming device.

2. Description of the Related Art

Image forming devices use toner for producing images on a media sheet. The toner is stored within a toner cartridge that is removable from the image forming device. Removal of the toner cartridge usually occurs when the toner has been depleted, if there are problems with the image forming device, and other miscellaneous occurrences.

The toner cartridge includes an outlet through which the toner flows to the image forming device. The image forming device includes a developer unit that has a receptacle to receive the toner from the toner cartridge outlet. The position of the developer unit in the image forming device has some variability or play due to a number of causes such as manufacturing tolerances, allowing the developer unit to move. Another cause of variation in position of the developer unit is that the developer unit is not fully constrained in its datum surfaces and points when the motors in the image forming device are not running. The motors create a reaction torque in the developer unit which forces the developer unit against its datums.

The toner cartridge outlet preferably includes a mechanism to control the flow of the toner to the developer unit. The mechanism includes an open position that allows toner to move from the toner cartridge to the developer unit, such as when the toner cartridge is inserted into the image forming device. The mechanism also includes a closed position that prevents toner from exiting the toner cartridge, such as when the toner cartridge is removed from the image forming device. Generally, the developer unit actuates the mechanism towards the open position during insertion of the toner cartridge and towards the closed position during removal of the toner cartridge.

However, if the developer unit is biased away from the mechanism during insertion of the toner cartridge, the developer unit may fail to actuate the mechanism and the toner cartridge may be difficult to install. Further, after insertion of the toner cartridge, if the developer unit is not properly aligned with respect to the toner cartridge, the toner may spill outside the receptacle on the developer unit. Toner may also spill upon removal of the toner cartridge due to improper alignment of the developer unit with respect to the toner cartridge.

It would be desirable therefore to provide an alignment feature that properly aligns a toner cartridge and developer unit to obviate the above mentioned problems.

SUMMARY OF THE INVENTION

Disclosed herein is an alignment member that is externally disposed on an electrophotographic toner cartridge to align an opening on a developer unit in an image forming device with an outlet on the toner cartridge, the alignment member comprises a first portion that moves the developer unit to a reference position when the toner cartridge is being inserted into the image forming device, and a second portion adjacent the first portion for maintaining the developer unit in the reference position at which the developer unit opening is aligned with the toner cartridge outlet for receiving toner from the toner cartridge when the cartridge has been inserted in the image forming device.

In a further form, the first portion of the alignment member makes an acute angle with a vertical axis in a clockwise direction and the second portion is positioned above the first portion and is parallel to the vertical axis.

In another embodiment, the alignment member includes a third portion adjacent the second portion, such that the third portion makes an acute angle with the vertical axis in a counter clockwise direction. The alignment member in a further form projects from a side surface of the cartridge below the outlet. In yet another embodiment, the alignment member sections comprise has a contiguous arcuate surface or a contiguous multiplanar surface having two or three planar surfaces.

In another aspect, an electrophotographic toner cartridge includes a toner reservoir having an outlet to supply toner to an image forming device, a shutter positioned adjacent the outlet and movable between an open orientation to allow toner to flow through the outlet and a closed orientation to prevent toner flow through the outlet, a shutter actuation mechanism coupled to the shutter and configured to engage an actuation pin positioned on a developer unit of the image forming device to move the shutter between one of the open and the closed orientations, and an alignment member positioned on a side surface of the cartridge below the shutter actuation mechanism and above the outlet and having a first portion for moving the developer unit to a reference position when the toner cartridge is being inserted into the image forming device, the reference position being a position at which an opening in the developer unit is aligned with the outlet for receiving toner therefrom, and a second portion adjacent the first portion for maintaining the developer unit in the reference position when the cartridge has been inserted.

In yet another aspect, an image forming device is disclosed that includes a housing, a developer unit mounted inside the housing and having an opening therein, and a toner cartridge having a toner reservoir with an outlet to supply toner to the image forming device, the toner cartridge having a shutter positioned adjacent the outlet and movable between an open orientation to allow toner supply through the outlet and a closed orientation to prevent toner supply through the outlet, a shutter actuation mechanism coupled to the shutter and configured to engage an actuation pin positioned on a developer unit of the image forming device to move the shutter towards one of the open and closed orientations, and an alignment member positioned below the shutter for aligning the developer unit with respect to the shutter, the alignment member having a first portion for moving the developer unit to a reference position when the toner cartridge is inserted into the housing, the reference position being a position where the developer unit opening is aligned with the shutter for receiving toner from the outlet and a second portion adjacent the first portion for maintaining the developer unit in the reference position.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
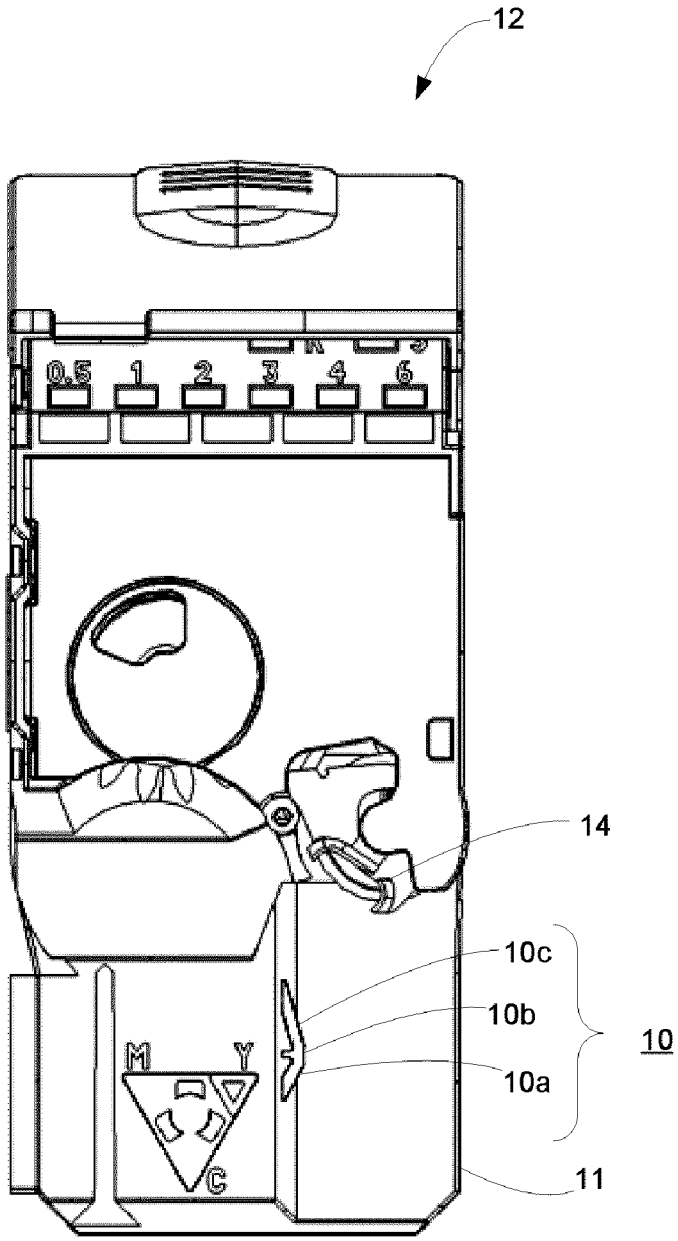
FIG. 1 is a front view of one embodiment of a toner cartridge with an alignment member according to the present invention.

Reference will now be made in detail to the exemplary embodiment(s) of the invention, as illustrated in the accompanying drawings. Whenever possible, the same reference numerals will be used throughout the drawings to refer to the same or like parts.

The present invention is directed to an alignment member that aligns a developer unit with a toner cartridge in an image forming device. FIG. 1 illustrates one embodiment of an alignment member 10 disposed on and immovably affixed to a side surface 11 of toner cartridge 12. As illustrated, the alignment member 10 projects outwardly from the side surface 11. The alignment member 10 includes a first portion 10*a* to align a developer unit 20 (shown in FIG. 2) with respect to the toner cartridge 12. The toner cartridge 12 has a toner reservoir with an outlet 30 (shown in FIG. 11) to supply toner to the developer unit 20. Essentially, the alignment member 10 aligns the outlet 30 on the toner cartridge 12 relative to the developer unit 20.

Figure 11:
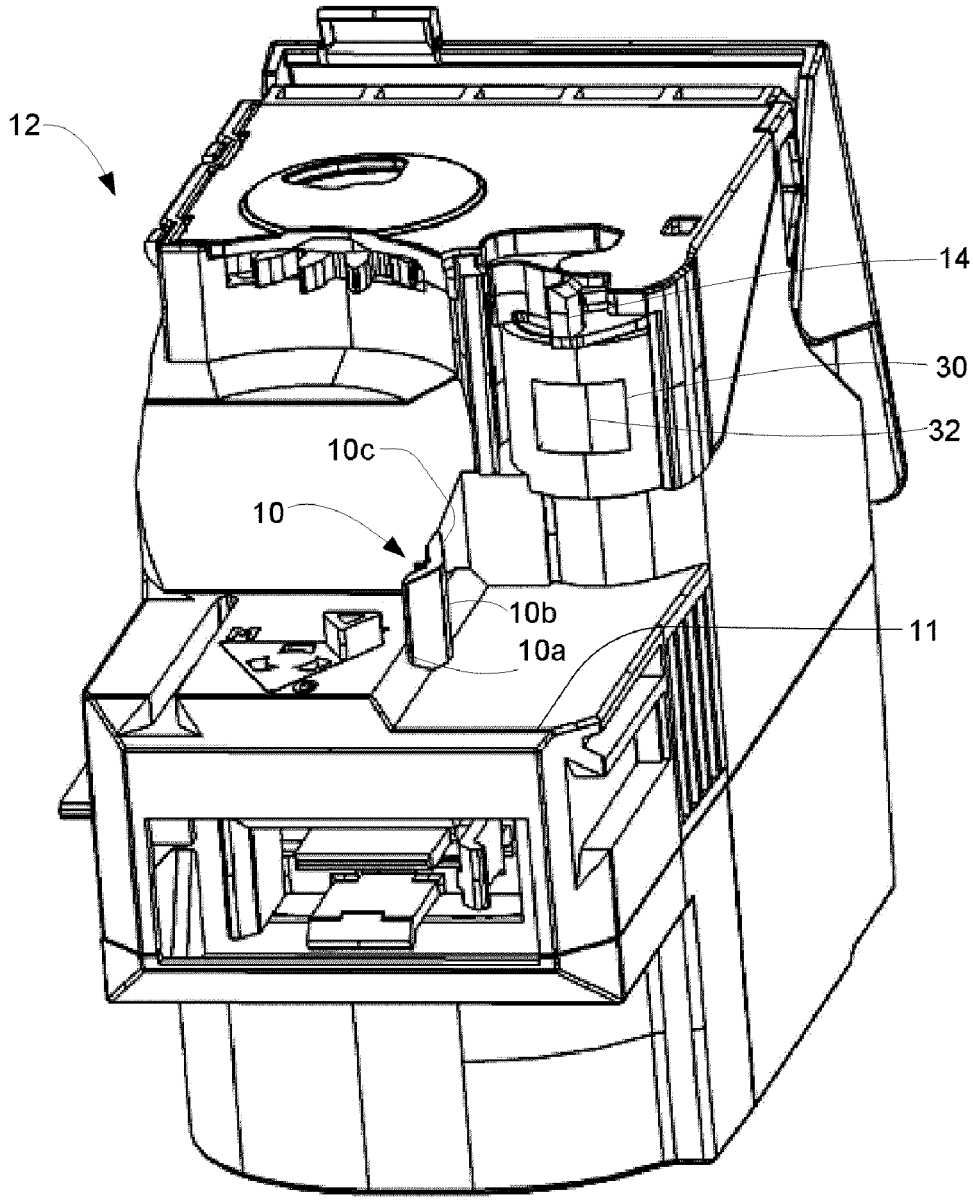
FIG. 11 is an isometric bottom view of the toner cartridge with one embodiment of an alignment member according to the present invention and also illustrating the shutter.

The outlet 30 on the toner cartridge 12 preferably has a rotatable shutter 32 to control the flow of toner through the outlet 30 (See FIG. 11). The shutter 32 is positioned adjacent the outlet 30. As shown, the shutter 32 is positioned inside the outlet 30. The shutter 32 is movable between an open orientation and a closed orientation. The toner cartridge 12 has a shutter actuation mechanism 14 operatively coupled to the shutter 32 to actuate the shutter 32 towards the open or closed orientation. The toner cartridge 12 may also have a biasing mechanism 52 (see FIG. 5 or FIG. 7) to move the shutter 32 towards one of the open or closed orientation in conjunction with the shutter actuation mechanism 14. In one embodiment, the biasing mechanism is a torsion spring. Preferably, the shutter actuation mechanism 14 is configured such that the shutter 32 snaps or rapidly moves between the open and closed orientations.

Figure 2:
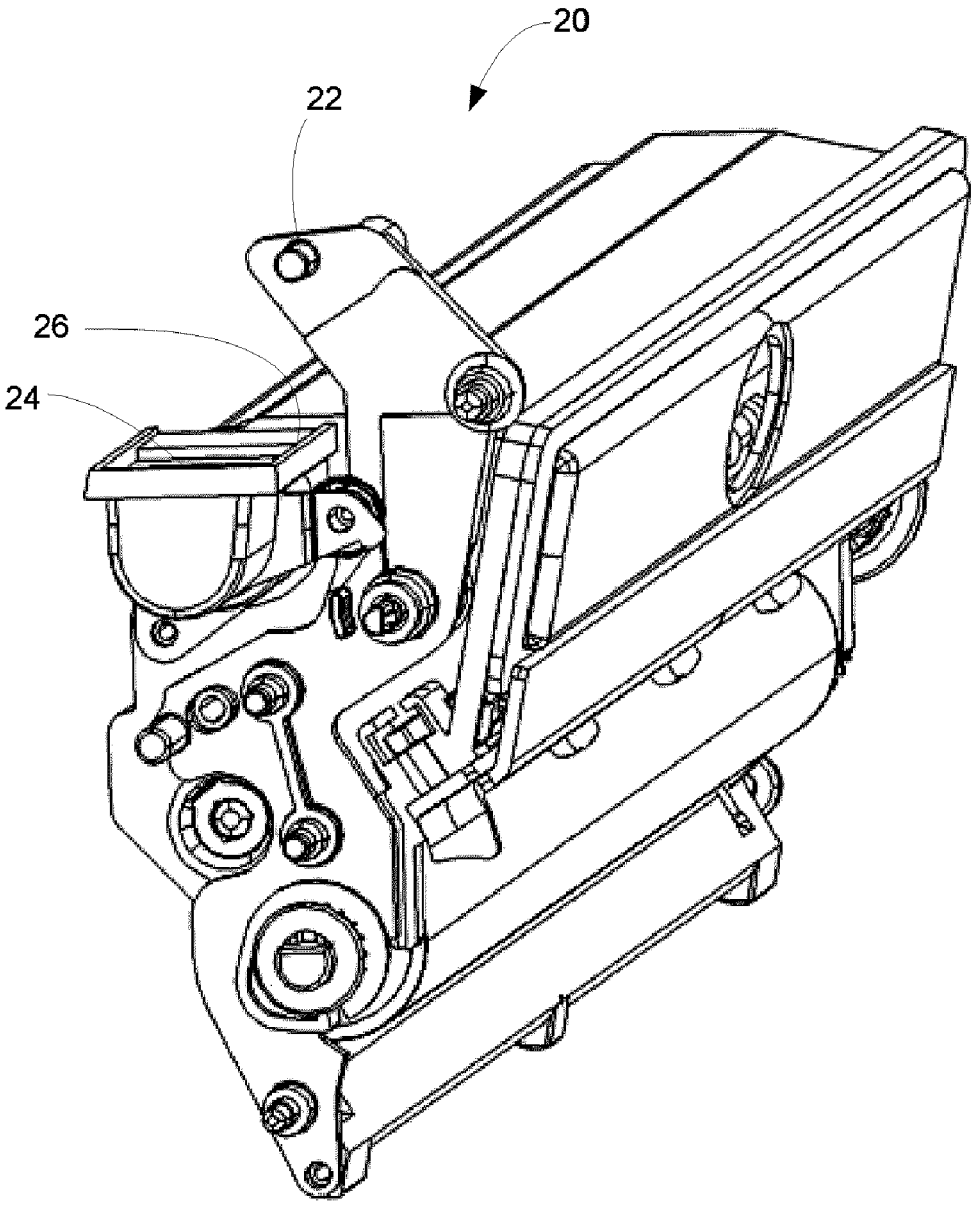
FIG. 2 is an isometric view of a representative developer unit to be aligned with the toner cartridge of FIG. 1.

The developer unit 20 shown in FIG. 2 has an opening 24 that receives toner from the outlet 30 of toner cartridge 12 when the toner cartridge is seating in the image forming device. The developer unit 20 is shown with its external gearing removed, the gearing is used to drive the internal components of the developer unit, in order to more clearly illustrate an actuation pin 22, the opening 24 and an engagement surface 26 that is provided adjacent opening 24. The actuation pin 22 engages with the shutter actuation mechanism 14 during insertion and removal of cartridge 12.

While the shutter 32 is in the closed orientation, the toner cartridge 12 may be inserted into an image forming device 100 (see FIG. 10) in a vertical insertion direction. FIGS. 3-8 illustrate one method of inserting the toner cartridge 12 into the image forming device 100 in a vertical insertion direction indicated by arrow A. During the initial portion of the insertion, the shutter 32 remains in the closed orientation so the toner does not flow through the outlet 30.

Figure 3:
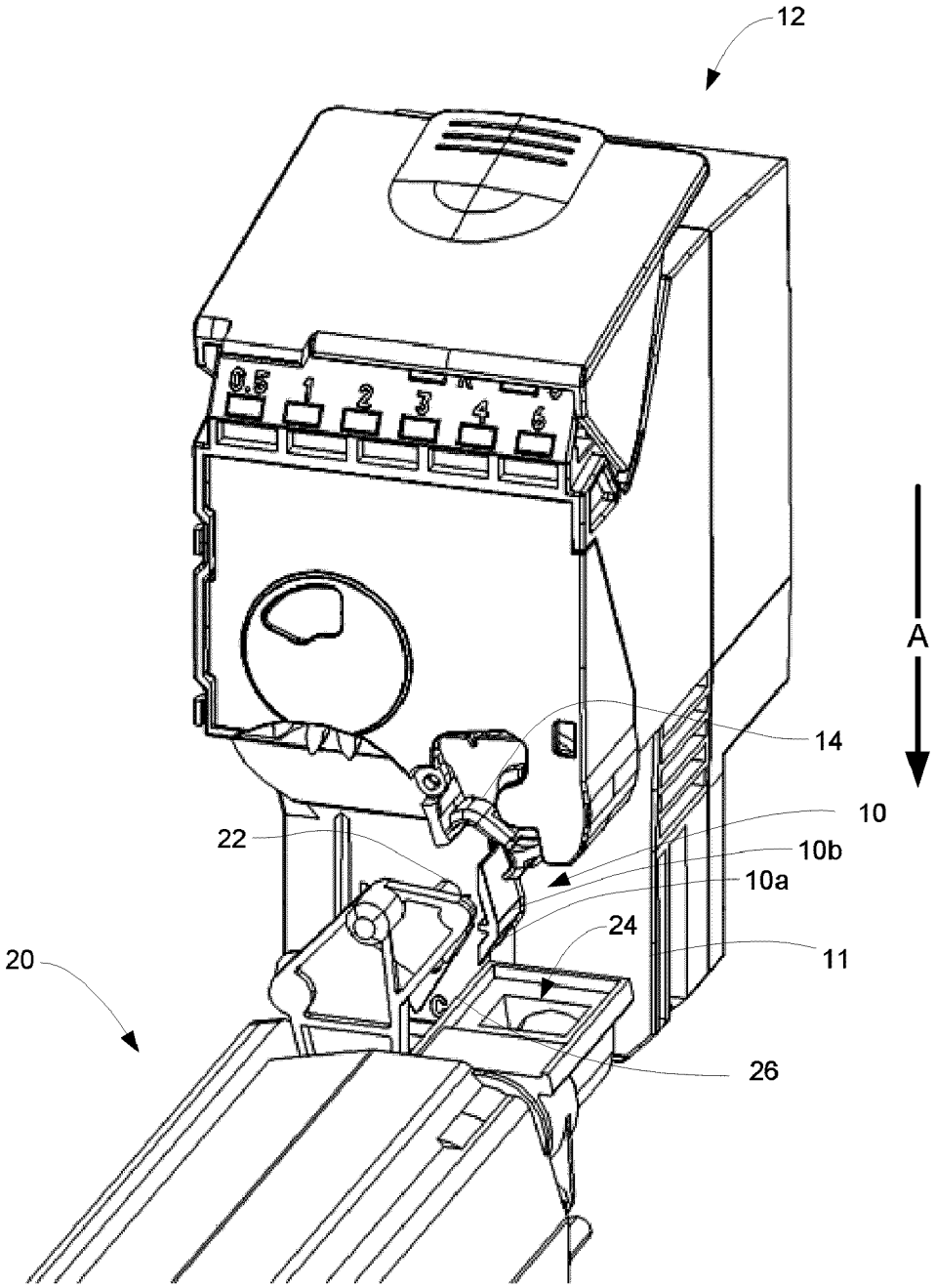
FIG. 3 illustrates the toner cartridge of FIG. 1 approaching the developer unit of FIG. 2 during insertion.
Figure 4:
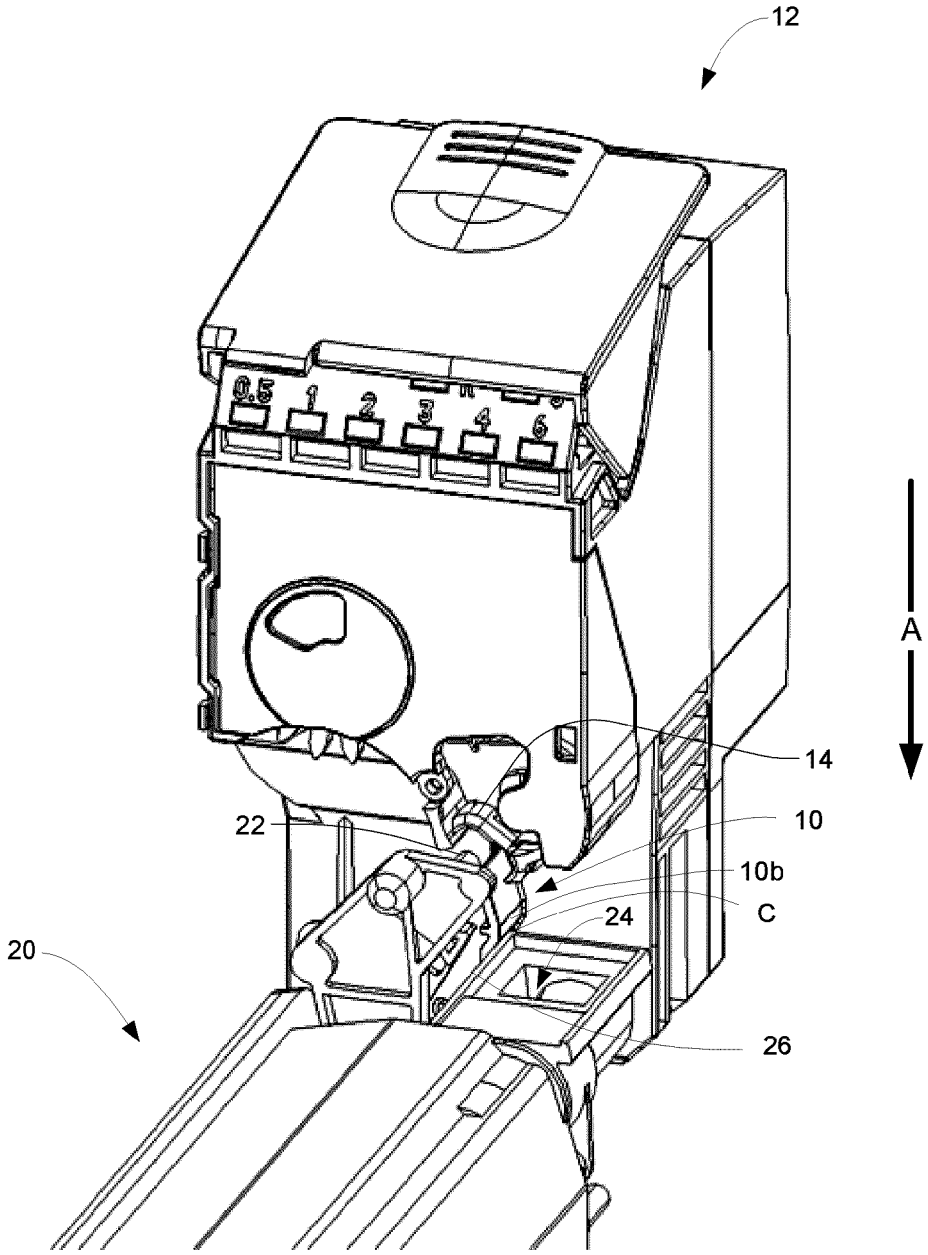
FIG. 4 illustrates the toner cartridge of FIG. 1 contacting the developer unit of FIG. 2 to move the developer unit to a reference position during insertion.
Figure 5:
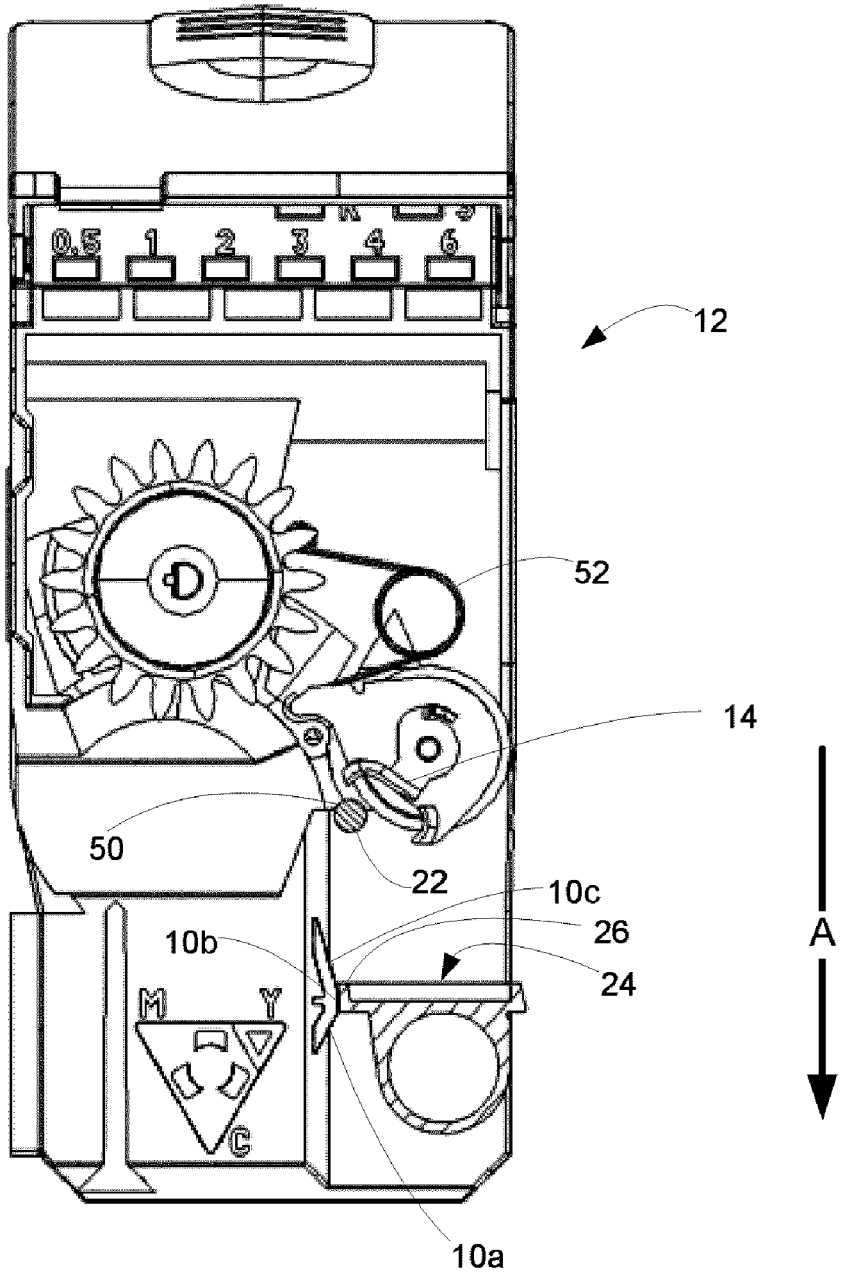
FIG. 5 is a front view of the toner cartridge aligned with a portion of the developer unit of FIG. 2 shown in section at the point of cartridge insertion shown in FIG. 4.

FIG. 3 illustrates the toner cartridge 12, along with the alignment member 10, approaching the developer unit 20 during insertion. A first portion 10*a* is a leading portion of the alignment member 10 when the toner cartridge 12 is inserted into the image forming device 100. First portion 10*a* is shown approaching engagement surface 26 while shutter actuation mechanism 14 approaches actuation pin 22. On continued insertion as illustrated in FIGS. 4 and 5, the first portion 10*a* of the alignment member 10 contacts engagement surface 26 on developer unit 20 while actuation pin 22 has not yet engaged with shutter actuation mechanism 14. After making contact, the first portion 10*a* of the alignment member 10 may move or guide the developer unit 20 horizontally to align the developer unit 20 and the toner cartridge 12.

After making contact with the developer unit 20 near opening 24, the first portion 10*a* of the alignment member 10 begins to align the opening 24 with the outlet 30. The alignment member 10 also has a second portion 10*b* which is adjacent the first portion 10*a*. The second portion 10*b* is positioned above the first portion 10*a* and in course of continued insertion and alignment, the second portion 10*b* contacts the developer unit 20 at the engagement surface 26 at point C near the opening 24 following the first portion 10*a*.

Figure 6:
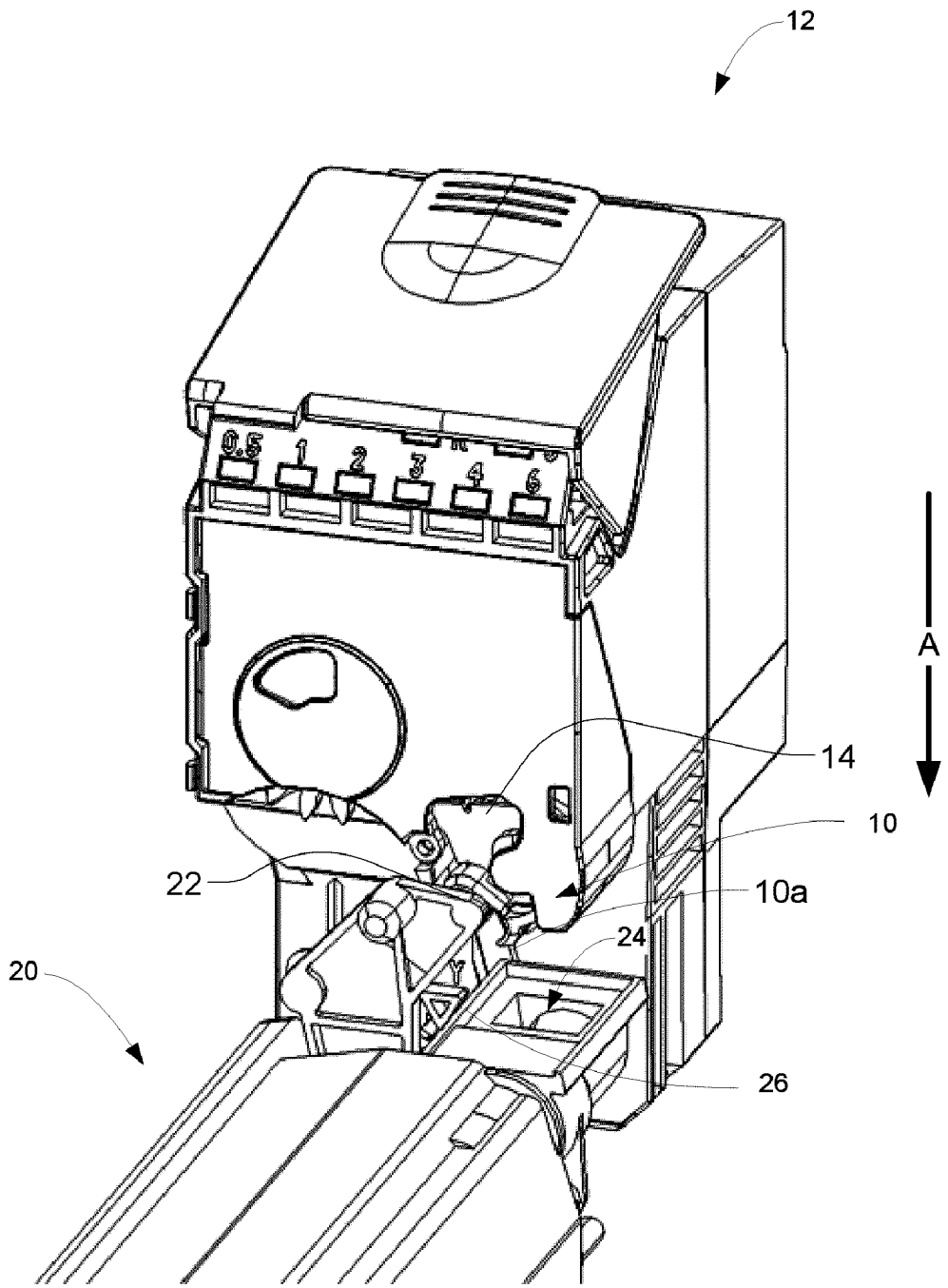
FIG. 6 illustrates the developer unit in the reference position actuating a shutter actuation mechanism on the toner cartridge of FIG. 1.
Figure 7:
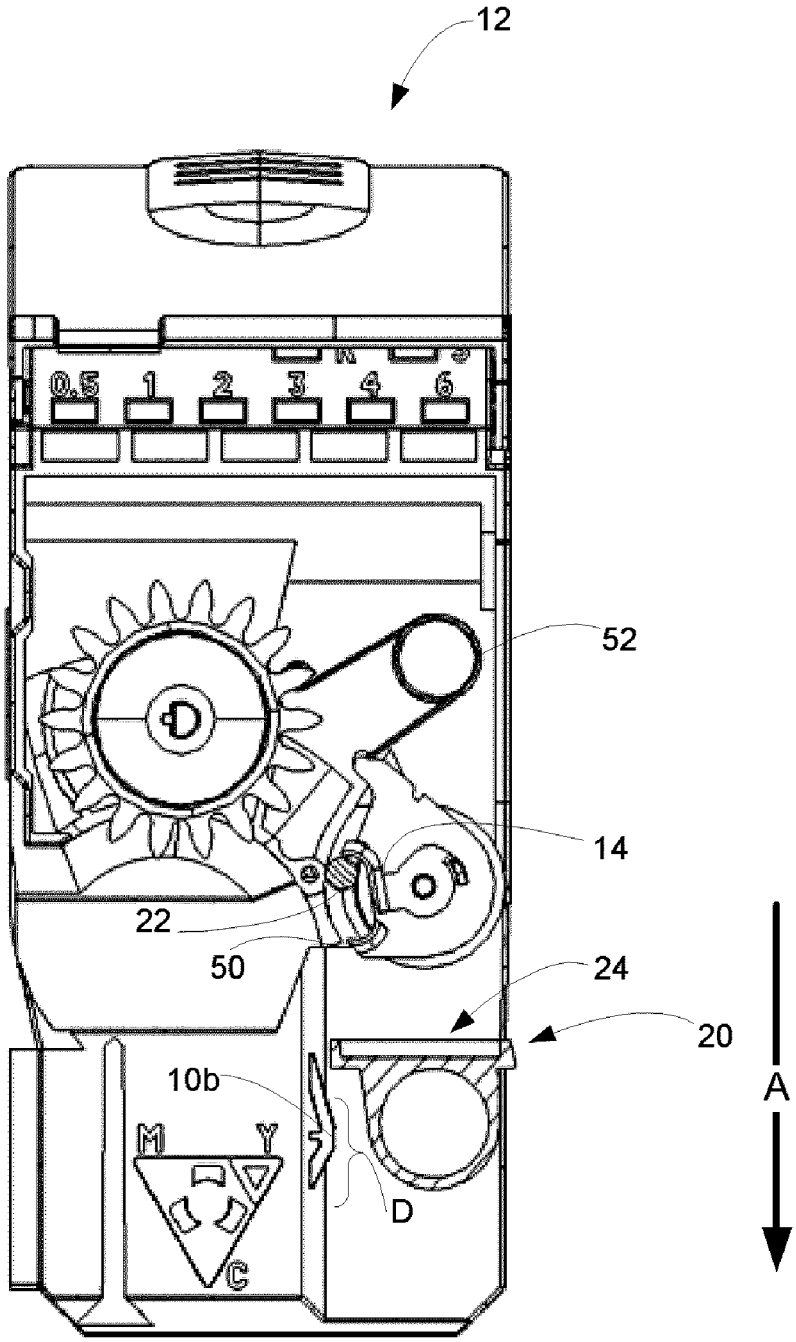
FIG. 7 illustrates the front view of the toner cartridge shown in FIG. 6 as the shutter actuation mechanism engages with the actuation pin shown in section of the developer unit also shown in section to open a shutter of the toner cartridge.

A position where the second portion 10*b* of the alignment member 10 contacts the developer unit 20 near opening or inlet 24 is called a reference position. For example, as shown in FIGS. 6 and 7, the reference position is attained when the second portion 10*b* of the alignment member 10 contacts in the region D a lower portion of engagement surface 26 of the developer unit 20. The first portion 10*a* may engage an upper portion of engagement surface 26 of the developer unit 20 before moving it to the reference position within the region D. In one embodiment, the first portion 10*a* of the alignment member 10 may move the developer unit 20 about 2-3 mm horizontally to bring it to the reference position. The second portion 10*b* engages the lower portion of engagement surface 26 to maintain the developer unit 20 in the reference position. In the reference position, the second portion 10*b* of the alignment member 10 maintains the alignment between the opening 24 on the developer unit 20 and the outlet 30 of the toner cartridge 12.

For properly aligning the opening 24 with the outlet 30, the first portion 10*a* of the alignment member 10 also aligns the cartridge with an actuation pin 22 on developer unit 20 that is positioned near the opening 24 on the developer unit 20. Preferably, the first portion 10*a* aligns the actuation pin 22 with respect to the shutter actuation mechanism 14, which is operatively coupled to the shutter 32. In one embodiment, the shutter 32 is cylindrical.

As illustrated in FIG. 5, during insertion the alignment member 10 also urges the actuation pin 22 to contact a lead-in surface 50 provided on side surface 11 of the toner cartridge 12. This contact ensures proper alignment of the actuation pin 22 with respect to the shutter actuation mechanism 14. As shown the actuation pin 22 engages the upper end of the shutter actuation mechanism that is curved to catch the actuation pin 22 as the toner cartridge 12 moves downward during insertion. The lead-in surface 50 may be positioned adjacent the shutter actuation mechanism 14.

In one embodiment, the first portion 10*a* of the alignment member 10 aligns the opening 24 with the outlet 30 prior to aligning the actuation pin 22 with respect to the shutter actuation mechanism 14. In another embodiment, the first portion 10*a* of the alignment member 10 simultaneously aligns the opening 24 with the outlet 30 and the actuation pin 22 with respect to the shutter actuation mechanism 14.

The toner cartridge 12 is further inserted a distance after the alignment with the first portion 10*a*. As shown in FIGS. 6 and 7, the shutter actuation mechanism 14 then engages the actuation pin 22, which begins to actuate the shutter actuation mechanism 14 to move the shutter 32 towards the open orientation. For example, as shown in FIG. 7, the actuation pin 22 exerts force on the shutter actuation mechanism 14 that causes the shutter actuation mechanism 14 to rotate in a clockwise direction as viewed in the figures. The clockwise rotation of the shutter actuation mechanism 14 in turn rotates the cylindrical shutter 32 to the open orientation. The actuation caused by the actuation pin 22 after alignment ensures proper opening of the shutter 32 at right time, i.e., when the opening 24 is aligned with the outlet 30 so that the toner does not spill outside the opening 24.

Figure 8:
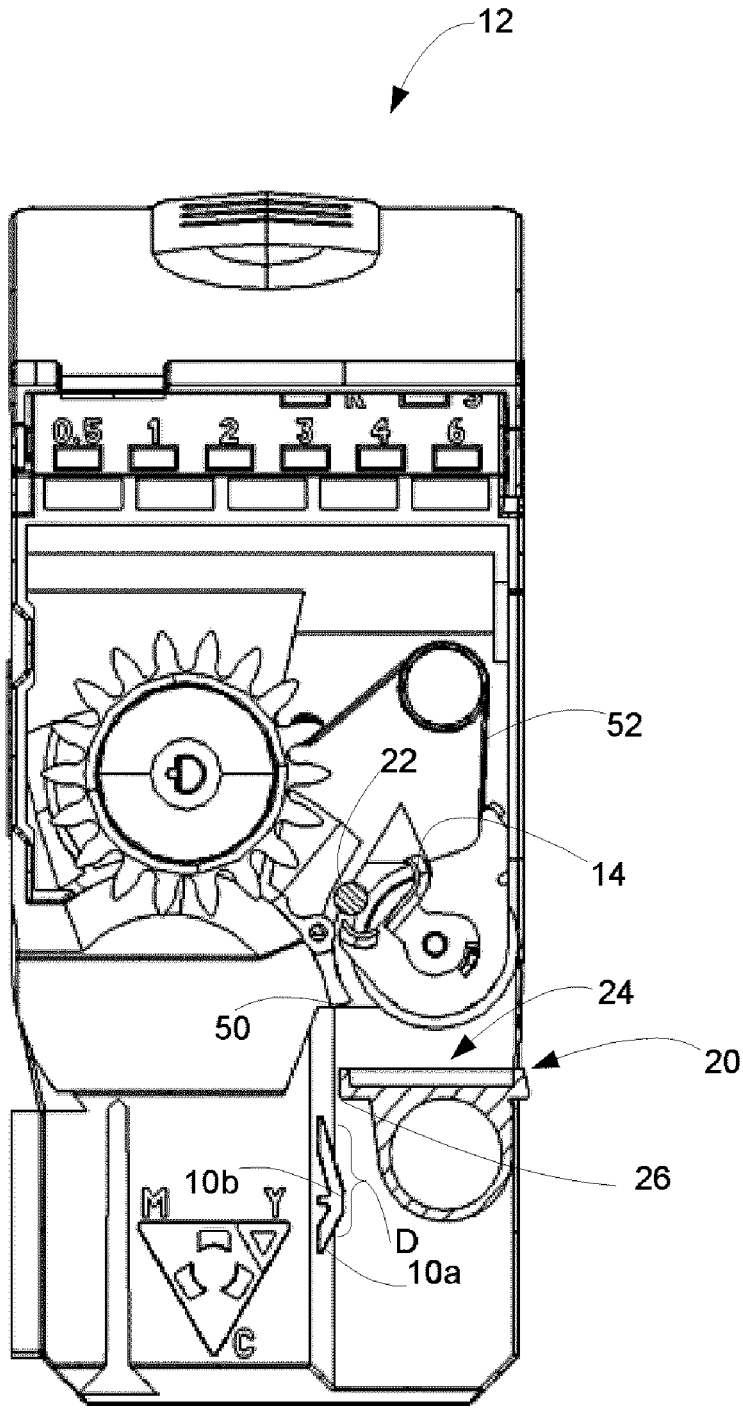
FIG. 8 illustrates the front view of the toner cartridge of FIG. 1 with the shutter in an open orientation and aligned with the developer unit shown in section at the reference position.
Figure 10:
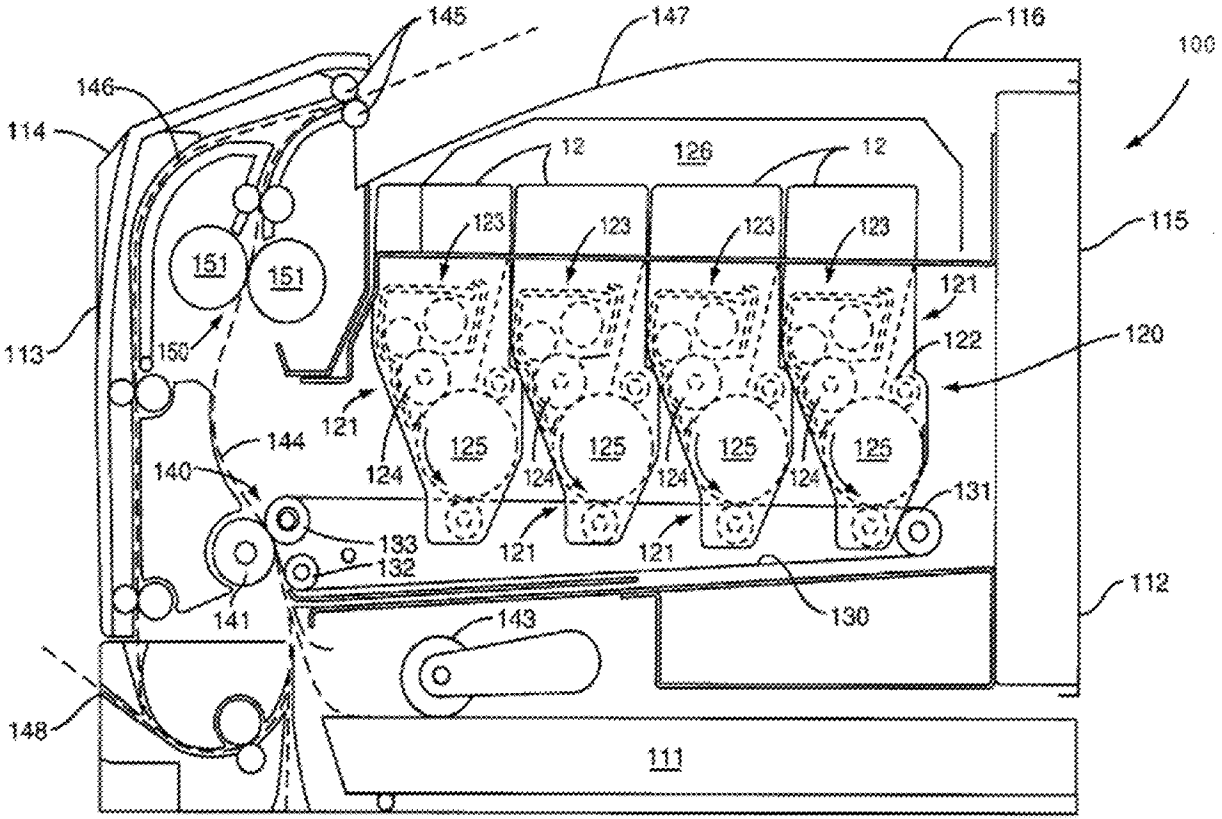
FIG. 10 is a side schematic view of one example of an image forming device incorporating the toner cartridge of FIG. 1.

FIG. 8 illustrates the toner cartridge 12 seated in the imaging device with the shutter 32 in the open orientation, the developer unit 20 in the reference position, and the opening 24 on the developer unit 20 aligned with the outlet 30 of the toner cartridge 12. In the open orientation, the toner moves through the outlet 30 into opening 24 on the developer unit 20. The first portion 10*a* and the second portion 10*b* of the alignment member 10 ensure proper seating of the toner cartridge 12 relative to the developer unit 20 in the image forming device 100 as illustrated in FIG. 10.

The first portion 10*a* of the alignment member 10 preferably faces downward towards bottom of the toner cartridge 12 making an acute angle with the vertical direction of insertion of the toner cartridge 12 in a first or clockwise direction as viewed in the figures, and the second portion 10*b* of the alignment member 10 is parallel to the vertical axis as illustrated in FIGS. 1, 5, and 7-9. The angle so formed appears like an inverted V with respect to the direction of insertion of the toner cartridge 12. The alignment member 10 may have a multi-planar, multi-angular surface formed by portions 10*a*, 10*b* and 10*c* that are angled as previously described or these portions may form a smooth contiguous surface.

Removal of the toner cartridge 12 from the image forming device 100 causes the shutter 32 to move in a similar manner from the open orientation to the closed orientation. As the toner cartridge 12 is initially lifted vertically from the image forming device 100 in a direction indicated by arrow B (shown in FIG. 9), the actuation pin 22 engages with the lower end of the shutter actuation mechanism 14 which in turn begins to move the shutter 32 towards the closed orientation. For example, the shutter actuation mechanism 14 may rotate in a counter clockwise direction to rotate the cylindrical shutter 32 towards the closed orientation. As cartridge 12 is lifted up, the force provided by actuation pin 22 against the shutter actuation mechanism 14 causes the shutter actuation mechanism 14 to rotate the shutter 32 back into the closed orientation as shown in FIG. 1 or 5.

In one embodiment, as illustrated in FIG. 1, 5, 7, 8 or 9 the alignment member 10 also preferably has a third portion 10*c* adjacent the second portion 10*b*. The third portion 10*c* is a leading portion of the alignment member 10 when the toner cartridge 12 is removed from the image forming device 100. The third portion 10*c* faces upward towards top of the toner cartridge 12 and makes an acute angle with the vertical direction of insertion of toner cartridge 12 in a second or counter clockwise direction, as viewed in the figures, to enable smooth removal of the toner cartridge 12. The second direction third portion 10*c* is opposite the first direction of the first portion 10*a*. The acute angle formed appears like a V with respect to the direction of insertion of the toner cartridge 12. The first, second and third portions 10*a*, 10*b*, and 10*c* may also be referred to as the first surface portion 10*a*, the second surface portion 10*b*, and the third surface portion 10*c*.

Figure 9:
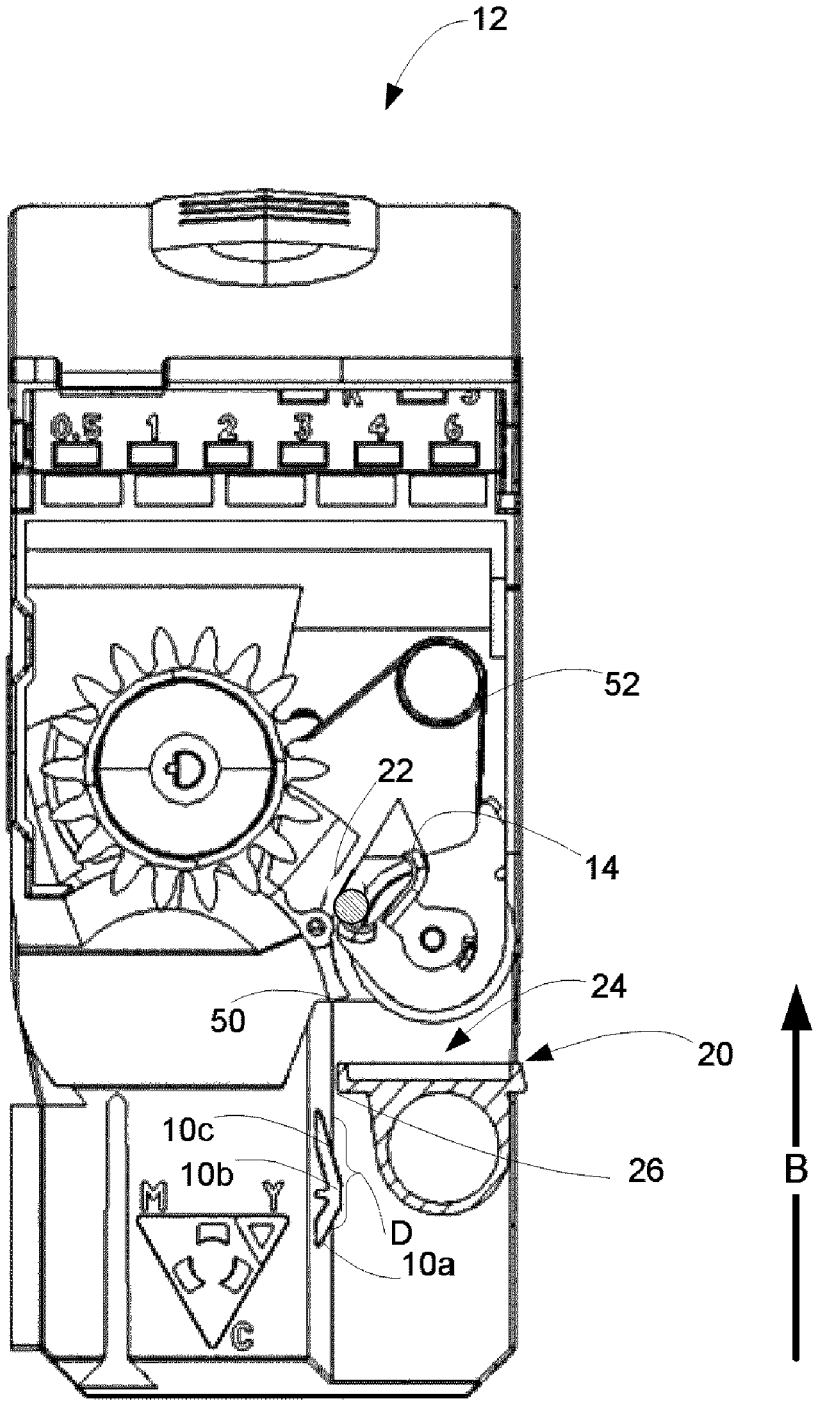
FIG. 9 illustrates the initiation of the removal of the toner cartridge of FIG. 1.

During toner cartridge removal, the developer unit 20 may get misaligned with respect to the toner cartridge 12. The misalignment may cause unwanted toner spill or allow the toner cartridge 12 to catch on part of the image forming device 100. During removal, the third portion 10*c* of the alignment member 10 adjusts the developer unit 20 relative to the toner cartridge 12 and corrects any misalignment to ensure proper removal, as best illustrated in FIG. 9. In one embodiment, the first portion 10*a*, the second portion 10*b*, and the third portion 10*c* of the alignment member 10 are three planar surfaces each having distinct boundaries or alternatively these surfaces may form a contiguous, multi-planar surface with no boundaries. In another embodiment, the second portion 10*b* is the smallest portion of the alignment member 10.

FIG. 10 illustrates one embodiment of an image forming device 100 that includes at least a toner cartridge 12 according to the present invention. The image forming device 100 includes a media input tray 111 positioned in a lower section of a housing 112. The media input tray 111 is sized to contain a stack of media sheets that will receive color or monochrome images. The media input tray 111 is preferably removable for refilling. A control panel 114 may be located on the front 113 of the housing 112. Using the control panel 114, the user is able to enter commands and generally control the operation of the image forming device 100. For example, the user may enter commands to switch modes (e.g., color mode, monochrome mode), view the number of images printed, take the image forming device 100 on/off line to perform periodic maintenance, and the like.

A first toner transfer area 120 includes one or more imaging units 121 that are aligned horizontally extending from the front 113 to a back 115 of the housing 112. In FIG. 10, imaging units 121 are shown in dashed line to indicate that each is mounted in housing 112 behind its respective toner cartridges 12 that are installed on housing 112. Each imaging unit 121 includes a charging roll 122, a developer unit 123 that includes various paddles and rollers for stirring and moving toner to a developer roll 124, and a rotating photoconductive (PC) drum 125. The charging roll 122 forms a nip with the PC drum 125, and charges the surface of the PC drum 125 to a specified voltage such as −1000 volts, for example. A laser beam (not shown) from a printhead 126 contacts the surface of the PC drum 125 and discharges those areas it contacts to form a latent image. In one embodiment, areas on the PC drum 125 illuminated by the laser beam are discharged to approximately −300 volts. The developer roll 124, which also forms a nip with the PC drum 125, then transfers toner particles in each developer unit 123 to the PC drum 125, to form a toned image. The toner particles are attracted to the areas of the PC drum 125 surface discharged by the laser beam from the printhead 126.

Toner cartridges 12 may be operatively connected to each of the developer units 123 in toner transfer relationship, when the toner cartridges 12 are inserted into the image forming device 100. Each toner cartridge 12 may be mounted and removed from the device 100 independently from its respective imaging unit 121. In one embodiment, the toner cartridges 12 each contain one of black, magenta, cyan, or yellow toner. Each of toner cartridges 12 may be substantially the same, or one or more of the toner cartridges 12 may hold different toner capacities. In one specific embodiment, the black toner cartridge 12 has a higher capacity than the others. The toner cartridges 12 may mount from a top 116 of the image forming device 100, in a generally vertical direction, and may detach during removal with the imaging units 121 remaining within the image forming device 100.

An intermediate transfer mechanism (ITM) 130 is disposed adjacent to each of the imaging units 121. In this embodiment, the ITM 130 is formed as an endless belt positioned about support roller 131, tension roller 132 and backup roller 133. During image forming operations, the ITM 130 moves past the imaging units 121 in a clockwise direction as viewed in FIG. 10. The toner images in their respective colors on one or more of the PC drums 125 is transferred to the ITM 130 and held there by a combination of surface tension and electrostatic charges. In one embodiment, a positive voltage field attracts the toned image from the PC drums 125 to the surface of the moving ITM 130.

The ITM 130 then conveys the toner images to a media sheet at a second transfer area. The second transfer area includes a second transfer nip 140 formed between the backup roller 133 and a second transfer roller 141.

A media path 144 extends through the image forming device 100 for moving the media sheets through the imaging process. Media sheets are initially stored in the input tray 111 or introduced into the housing 112 through a manual feeder 148. The sheets in the input tray 111 are picked by a pick mechanism 143 and moved into the media path 144. In this embodiment, the pick mechanism 143 includes a roller positioned at the end of a pivoting arm. The roller rotates to move the media sheets from the input tray 111 towards the second transfer area. In one embodiment, the pick mechanism 143 is positioned in proximity (i.e., less than a length of a media sheet) to the second transfer area with the pick mechanism 143 moving the media sheets directly from the input tray 111 into the second transfer nip 140. For sheets entering through the manual feeder 148, one or more driven rollers are positioned to move the sheet into the second transfer nip 140.

The media sheet receives the toned image from the ITM 130 as it moves through the second transfer nip 140. The media sheet with toned images are then moved along the media path 144 and into a fuser area 150. Fuser area 150 includes fusing rollers or belts 151 that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

In one embodiment, the alignment member 10 is disposed or positioned vertically below the outlet 30 on the toner cartridge 12. In another embodiment, the alignment member 10 may be displaced from the outlet 30 on at least two of the x, y, and z axis, as illustrated in FIG. 11.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An alignment member externally disposed on an electrophotographic toner cartridge mountable on an image forming device for aligning an opening on a developer unit in the image forming device with an outlet on the toner cartridge, the alignment member comprising:

a first surface portion and a second surface portion immovably affixed to the toner cartridge;

the first surface portion for engaging and guiding the developer unit to a reference position with respect to the toner cartridge when the toner cartridge is being downwardly inserted in a vertical direction of insertion into the image forming device; and the second surface portion parallel to the vertical direction of insertion and adjacent the first surface portion for maintaining the developer unit in the reference position at which the developer unit opening is aligned with the toner cartridge outlet for receiving toner from the toner cartridge through the outlet when the cartridge has been inserted in the image forming device.

2. The alignment member of claim 1, wherein the alignment member projects from a side surface of the toner cartridge and is positioned below the outlet.

3. The alignment member of claim 1 wherein the alignment member is disposed on a side surface of the toner cartridge such that the alignment member is displaced from the outlet on at least two of x, y, and z axes.

4. The alignment member of claim 1, wherein the first surface portion makes an acute angle with respect to the vertical direction of insertion of the toner cartridge forming an inverted V in a first direction and the second surface portion is positioned above-the first surface portion.

5. The alignment member of claim 4 further comprising a third surface portion adjacent the second surface portion, wherein the third surface portion makes an acute angle with respect to the vertical direction of insertion of the toner cartridge forming a V in a second direction that is opposite the first direction.

6. The alignment member of claim 5, wherein the first surface portion is a leading surface portion when the toner cartridge is inserted into the image forming device and the third surface portion is a leading surface portion when the toner cartridge is removed from the image forming device.

7. The alignment member of claim 5, wherein the first surface portion, the second surface portion, and the third surface portion form a contiguous arcuate surface.

8. The alignment member of claim 5, wherein the first surface portion, the second surface portion and the third surface portion are three adjoining planar surfaces.

9. An electrophotographic toner cartridge mountable on an image forming device, comprising:

a toner reservoir having an outlet to supply toner to a developer unit mounted in the image forming device;

a shutter positioned adjacent the outlet and movable between an open orientation to allow toner flow through the outlet and a closed orientation to prevent toner flow through the outlet;

a shutter actuation mechanism coupled to the shutter for engaging an actuation pin positioned on a developer unit of the image forming device to move the shutter between one of the open and the closed orientations; and an alignment member immovably affixed on the exterior of the toner cartridge and positioned below the shutter actuation mechanism and below the outlet, the alignment member having:

a first surface portion for engaging and guiding the developer unit to a reference position when the toner cartridge is being inserted into the image forming device, the reference position being a position at which an opening in the developer unit is aligned with the outlet for receiving toner therefrom; and a second surface portion parallel to the vertical direction of insertion and adjacent the first surface portion for maintaining the developer unit in the reference position when the toner cartridge has been inserted.

10. The toner cartridge of claim 9, wherein the alignment member projects from a side surface of the toner cartridge.

11. The toner cartridge of claim 9, wherein the first surface portion, the second surface portion, and the third surface portion form a contiguous multi-planar surface.

12. The toner cartridge of claim 9, wherein during insertion of the toner cartridge the actuation pin contacts the shutter actuation mechanism that in turn moves the shutter to the open orientation, and wherein during removal of the toner cartridge the actuation pin contacts the shutter actuation mechanism that in turn moves the shutter to the closed orientation.

13. The toner cartridge of claim 9, wherein the first surface portion of the alignment member is at an acute angle with respect to the vertical direction of insertion of the toner cartridge forming an inverted V in a first direction, and wherein the second surface portion of the alignment member is positioned following the first surface portion.

14. The toner cartridge of claim 13, wherein the alignment member further comprises a third surface portion positioned following the second surface portion and making an acute angle with respect to the direction of insertion of the toner cartridge forming a V in a second direction opposite the first direction.

15. An image forming device comprising:

a housing;

a developer unit mounted inside the housing and having an opening therein; and a toner cartridge mounted on the housing and having a toner reservoir with an outlet to supply toner to a developer unit of the image forming device, the toner cartridge having:

a shutter positioned adjacent the outlet and movable between an open orientation to allow toner supply through the outlet and a closed orientation to prevent toner supply through the outlet;

a shutter actuation mechanism coupled to the shutter for engaging an actuation pin positioned on the developer unit to move the shutter towards one of the open and closed orientations; and an alignment member immovably affixed to the toner cartridge and positioned below the shutter for aligning the developer unit with the shutter, the alignment member having:

a first surface portion for guiding the developer unit to a reference position when the toner cartridge is inserted into the housing, the reference position being a position where an opening in the developer unit is aligned with the shutter for receiving toner from the outlet; and a second surface portion positioned parallel to a direction of insertion of the toner cartridge and is adjacent the first surface portion for maintaining the developer unit in the reference position.

16. The image forming device of claim 15, wherein during insertion of the toner cartridge the actuation pin actuates movement of the shutter actuation mechanism that in turn moves the shutter to the open orientation, and wherein during removal of the toner cartridge the actuation pin actuates movement of the shutter actuation mechanism that in turn moves the shutter to the closed orientation.

17. The image forming device of claim 15, wherein the first surface portion of the alignment member makes an acute angle with respect to the direction of insertion of the toner cartridge forming an inverted V in a first direction, and wherein the second surface portion of the alignment member is positioned following the first surface portion.

18. The image forming device of claim 17, wherein the alignment member further comprises a third surface portion positioned following the second surface portion, the third surface portion making an acute angle with respect to the direction of insertion of the toner cartridge forming a V in a second direction opposite the first direction.

19. The image forming device of claim 18, wherein the first surface portion, the second surface portion, and the third surface portion form a contiguous multiplanar surface.

* * * * *